US006054017A

United States Patent [19]

Yang et al.

[11] Patent Number: 6,054,017

[45] Date of Patent: Apr. 25, 2000

[54] CHEMICAL MECHANICAL POLISHING PAD WITH CONTROLLED POLISH RATE

[75] Inventors: Fu-Liang Yang, Tainan; Bih-Tiao Lin, Ping Tung, both of Taiwan

[73] Assignee: Vanguard International Semiconductor Corporation, Hsinchu, Taiwan

[21] Appl. No.: 09/041,086

[22] Filed: Mar. 10, 1998

[51] Int. Cl.[7] ..... B24B 7/02; B24B 7/30; B24B 29/04

[52] U.S. Cl. ..... 156/345; 451/288; 451/289; 451/290; 451/526; 451/921

[58] Field of Search ..... 156/345; 451/288, 451/289, 290, 526, 921

[56] References Cited

U.S. PATENT DOCUMENTS

| | | | |
|---|---|---|---|
| 5,435,772 | 7/1995 | Yu | 451/288 |
| 5,635,083 | 6/1997 | Breivogel et al. | 451/289 |
| 5,672,095 | 9/1997 | Morimoto et al. | 451/288 |

*Primary Examiner*—Robert E. Sellers
*Attorney, Agent, or Firm*—Christensen O'Connor Johnson & Kindness PLLC

[57] ABSTRACT

A chemical mechanical polish apparatus (FIG. 3B) for planarizing a semiconductor wafer (31) is disclosed. The apparatus includes a polishing pad (21) and a polishing head (32). The polishing pad includes a surface for polishing the semiconductor wafer. The surface has a hole (20). The polishing head is cooperatively engaged with the polishing pad. The polishing head holds the semiconductor wafer and applies it against the polishing pad. Both the polishing head and the polishing pad are rotatable.

20 Claims, 4 Drawing Sheets

CHEMICAL MECHANICAL POLISHING PAD WITH CONTROLLED POLISH RATE

FIELD OF THE INVENTION

The present invention relates to an apparatus used in semiconductor fabrication, and more particularly, to a chemical mechanical polishing pad.

BACKGROUND OF THE INVENTION

During manufacture of integrated circuits, a planarization process is often utilized to flatten the surface of a semiconductor wafer. There are many methods of performing the planarization process. When global planarization is required, chemical mechanical polishing, as an alternative to other etchback techniques, is utilized to polish the top layer of the semiconductor wafer.

As shown in FIG. 1A, the conventional chemical mechanical polish (CMP) apparatus includes a polishing pad 10 and a polishing head 12. The polishing pad 10 is configured to have a round shape. A slurry typically consisting of colloidal silica, dispersed aluminum and KOH or $NH_4OH$ is applied to the top surface of the polishing pad 10. The polishing pad 10 rotates in a counterclockwise direction, while the polishing head 12 rotates in a clockwise direction. As shown in FIG. 1B, a semiconductor wafer 11 is positioned between the polishing pad 10 and the polishing head 12. The diameter of the polishing pad 10 is greater than the diameter of the semiconductor wafer 11. The semiconductor wafer 11 is secured on a top surface of the polishing pad 10 by the polishing head 12. In particular, the polishing head 12 uses a vacuum chuck set 15 to secure the semiconductor wafer 11. In this way, the semiconductor wafer 11 is held by the polishing head 12, while the front surface of the semiconductor wafer 11 is pressed against the top surface of the polishing pad 10. The semiconductor wafer 11 spins with the polishing head 12 in a clockwise direction.

During polishing, the polishing head 12 rotates with a predetermined speed and presses the semiconductor wafer 11 against the polishing pad 10 so that the semiconductor wafer 11 is polished against the polishing pad 10. The polishing pad 10 is fixed on the surface of a rotatable table 14, which spins in a counterclockwise direction, driving the polishing pad 10 in the same direction. In this manner, the semiconductor wafer 11 is polished at a particular polish rate.

FIG. 1C is a simplified graph depicting the polish rate of the semiconductor wafer 11 as a function of the diameter of the semiconductor wafer 11. It will be appreciated that the polish rate has larger values near the rim of the semiconductor wafer 11 compared to the center of the semiconductor wafer 11. The nonuniformity in the polish rate of the semiconductor wafer 11 increases with an increase in the size of the semiconductor wafer 11. For example, the nonuniformity in the polish rate for 12-inch semiconductor wafers is more dramatic than for 8-inch semiconductor wafers.

One primary disadvantage of the conventional chemical mechanical polish involves the nonuniformity of the polish rate. The nonuniformity is caused by a variety of factors. First, the rotating orientation of the semiconductor wafer 11 relative to the polishing pad 10 causes nonuniformity. Also, the top surface of the polishing pad 10 is typically not planar. As a result, its nonplanar orientation is undesirably transferred to the semiconductor wafer 11 during polishing. Furthermore, the pressure applied by the polishing head 10 to the semiconductor wafer 11 may be nonuniform, causing the polish rate on the surface of the semiconductor wafer 11 to be nonuniform.

SUMMARY OF THE INVENTION

In accordance with the present invention, an apparatus for planarizing a semiconductor wafer is disclosed. The apparatus includes a polishing pad and a polishing head. The polishing pad includes a surface for polishing the semiconductor wafer. The surface has a nonabrasive portion. The polishing head is cooperatively engaged with the polishing pad. The polishing head holds the semiconductor wafer and applies it against the polishing pad. Both the polishing head and the polishing pad are rotatable.

BRIEF DESCRIPTION OF THE DRAWINGS

The above features of the present invention will be more clearly understood from consideration of the following descriptions in connection with accompanying drawings in which.

DETAILED DESCRIPTION OF THE PREFERRED EMBODIMENT

Chemical mechanical polishing (CMP) is often used in semiconductor fabrication for planarization. The present invention discloses a chemical mechanical polishing (CMP) apparatus to planarize the surface of a semiconductor wafer to improve topography. The chemical mechanical polish apparatus according to the present invention is capable of planarizing semiconductor wafers of all sizes, including large-sized semiconductor wafers.

Figure 1A:
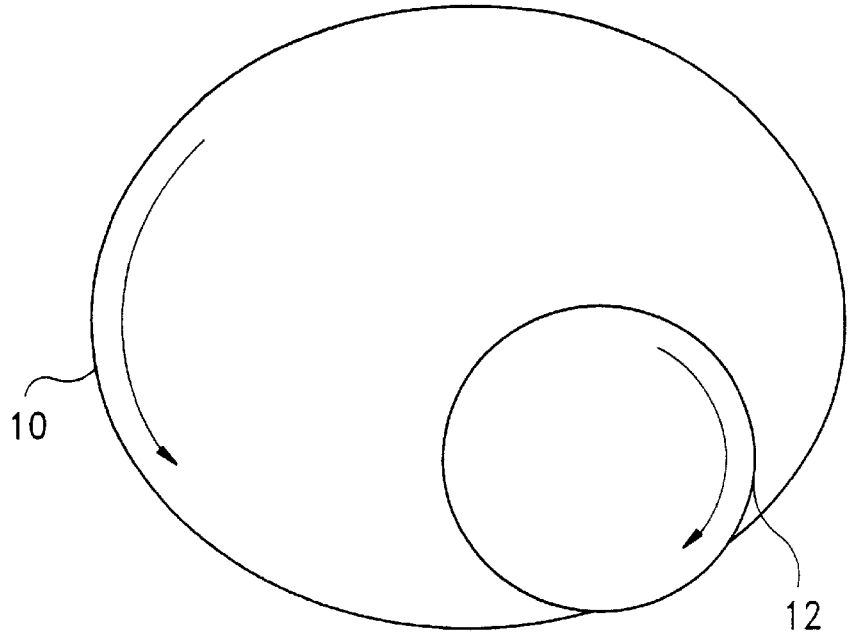
FIGURE 1A (Prior Art)
FIG. 1A is a top view of an apparatus for planarizing a semiconductor wafer in accordance with the prior art.
Figure 1B:
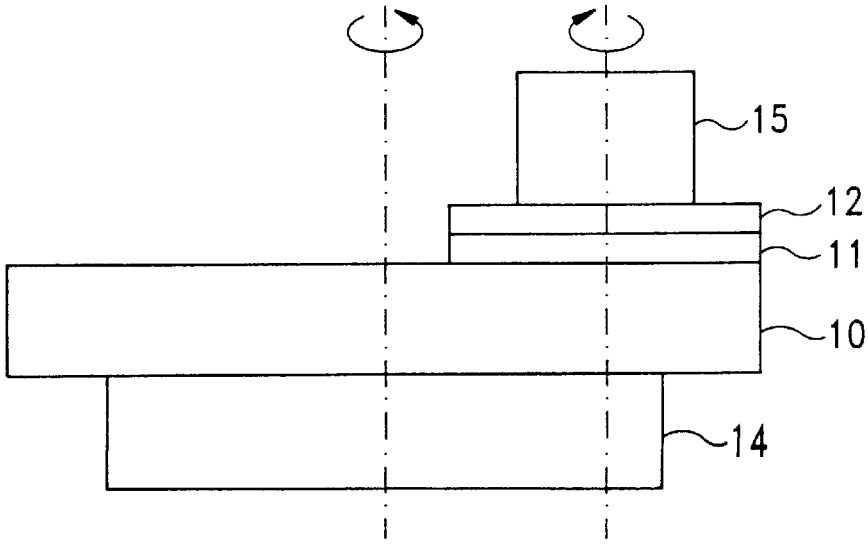
FIGURE 1B (Prior Art)
FIG. 1B is a cross-sectional view of the apparatus shown in FIG. 1A.
Figure 1C:
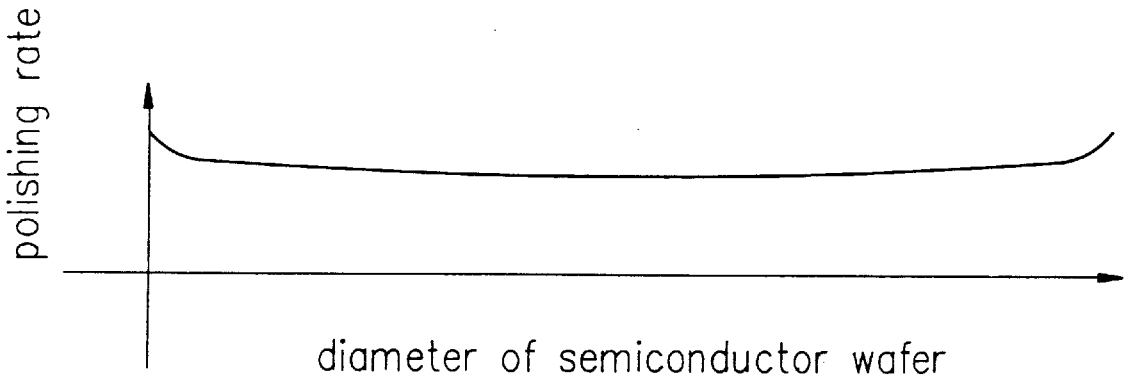
FIGURE 1C (Prior Art)
FIG. 1C is a graph of the polish rate of a semiconductor wafer when polished by the apparatus shown in FIGS. 1A and 1B.
Figure 2:
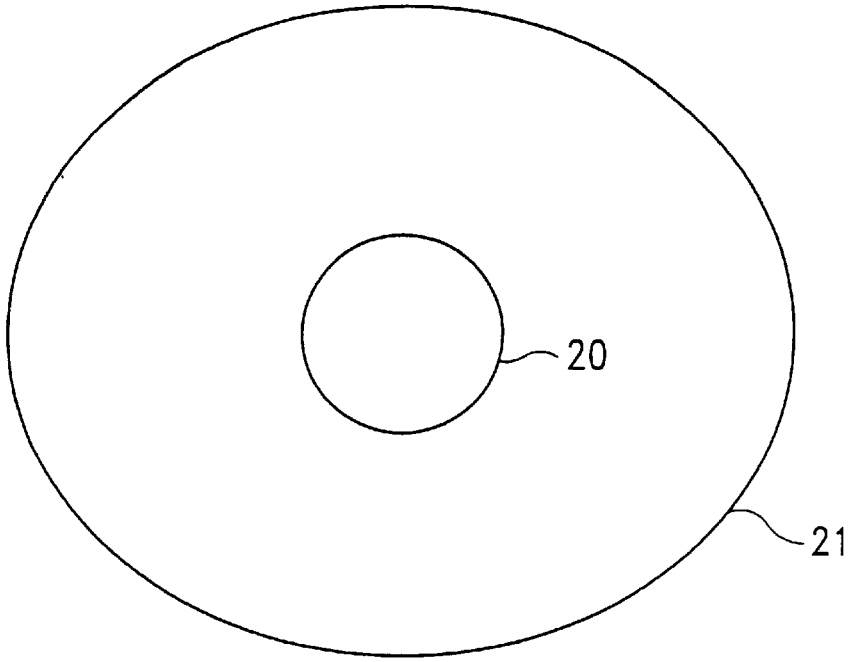
FIG. 2 illustrates a polishing pad of an apparatus for planarizing a semiconductor wafer according to the present invention.
Figure 3A:
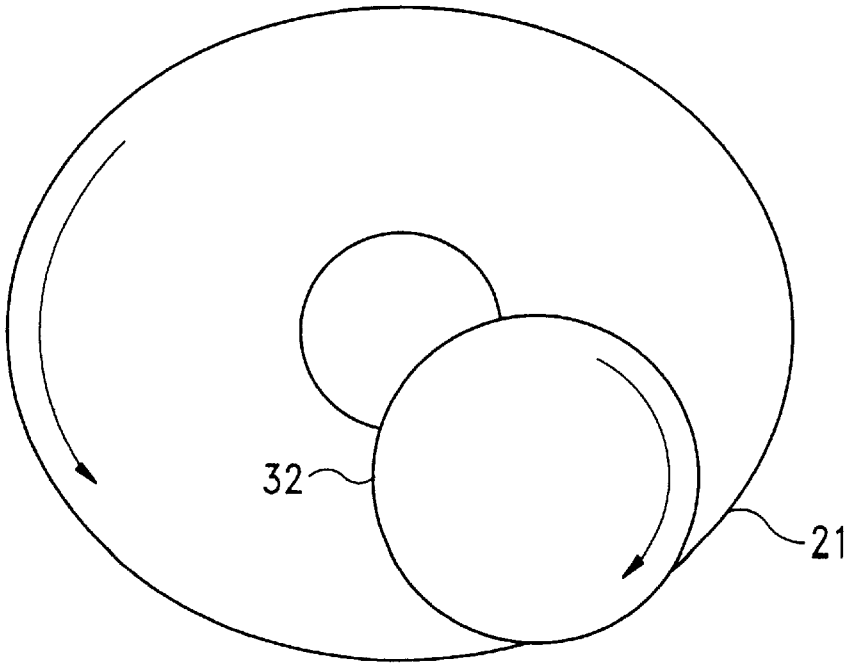
FIG. 3A shows a top view of the apparatus according to the present invention shown in FIG. 2.
Figure 3B:
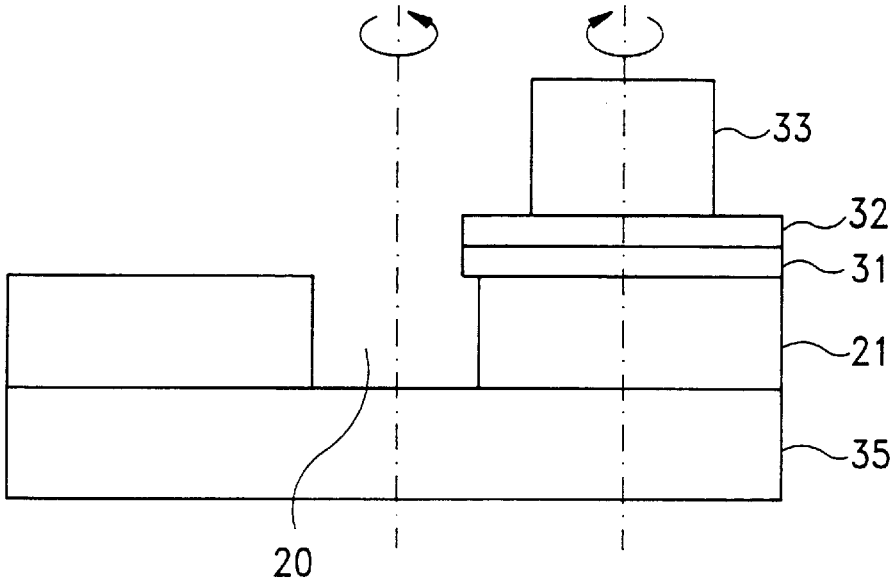
FIG. 3B is a cross-sectional view of the apparatus according to the present invention shown in FIG. 3A.

FIGS. 2–3B illustrate the chemical mechanical polish apparatus according to the present invention. As shown in FIG. 2, the chemical mechanical polish apparatus includes a polishing pad 21, having a hole 20 at the center thereof. The polishing pad 21 is circular. The hole 20 is preferably a circular region. However, the hole 20 can be configured to have other shapes. Furthermore, instead of the hole 20, the polishing pad 21 could include a region having a material that is nonabrasive to semiconductor wafers. Alternatively, the region could have a material that is less abrasive to semiconductor wafers than other regions of the polishing pad 21. The region could be circular, or a different shape, and centrally located in the polishing pad 21. During the polishing process, a slurry is applied to the polishing pad 21. The slurry typically includes colloidal silica, dispersed aluminum and KOH or $NH_4OH$. The polishing pad 21 is securely positioned on a rotatable table 35.

As shown in FIGS. 3A–3B, the chemical mechanical polish apparatus also includes a polishing head 32. A semiconductor wafer 31 is disposed between the polishing pad 21 and the polishing head 32. The diameter of the polishing pad 21 is greater than the diameter of the semiconductor wafer 31. The polishing head 32 positions the semiconductor wafer 31 on a surface of the polishing pad 21. The polishing head 32 holds the semiconductor wafer 31 by using a vacuum chuck set 33. The vacuum chuck set 33 applies a pressure to secure the semiconductor wafer 31.

Figure 4:
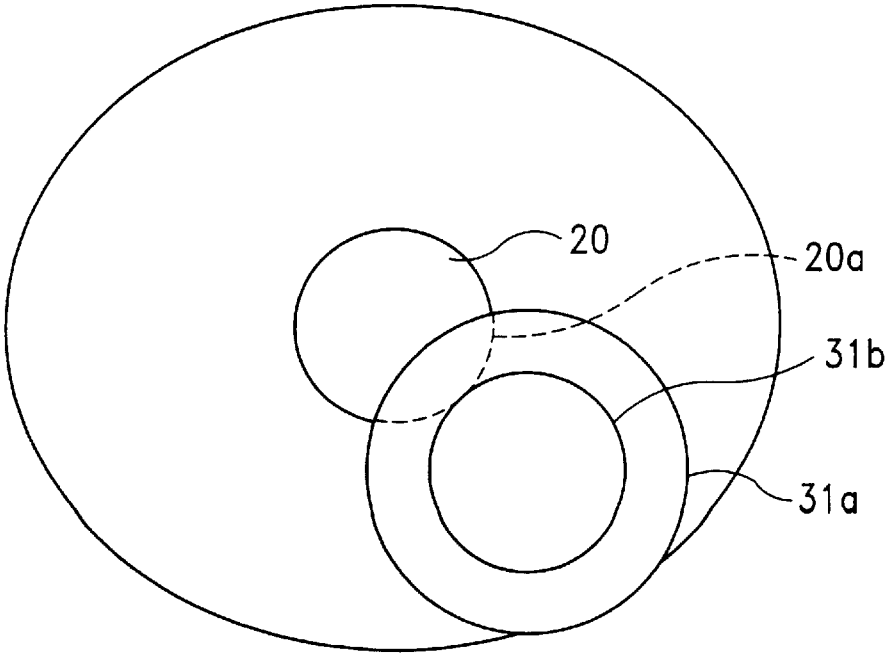
FIG. 4 illustrates an outer ring of a semiconductor wafer superimposed on the polishing pad shown in FIG. 2.

During polishing, the rotatable table 35 rotates in a counterclockwise direction, causing the polishing pad 21 to also rotate in the counterclockwise direction. The polishing head 32 rotates at a predetermined speed in a clockwise direction, causing the semiconductor wafer 31 to also rotate in the clockwise direction. The polishing head can also rotate in the same direction as the polishing pad. As shown in FIG. 4, as the chemical mechanical polish apparatus polishes the semiconductor wafer 31, an outer ring 31*a* of the semiconductor wafer 31 overlaps with the hole 20. A circular, inner area 31*b* of the semiconductor wafer 31, within the outer ring 31*a*, does not engage the hole 20. An overlapping region 20*a* represents the area where the semiconductor wafer 31 overlaps with the hole 20. Accordingly, the hole 20 causes the polish rate of the outer ring 31*a* to be less than the polish rate of the inner area 31*b*. The polish rate of the outer ring 31*a* is decreased by the following factor:

$$\frac{B}{A} \tag{1}$$

where A is the overlapping region 20*a*; and

B is the area of the outer ring 31*a*.

The reduced polish rate of the chemical mechanical polish apparatus in accordance with the present invention overcomes the disadvantages associated with nonuniformity caused by prior art semiconductor fabrication techniques.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for planarizing a semiconductor wafer, the apparatus comprising:

a polishing pad having a surface for polishing the semiconductor wafer, said surface having a nonabrasive portion, said nonabrasive portion being positioned at center of said polishing pad, said polishing pad having a diameter greater than a diameter of the semiconductor wafer, said nonabrasive portion of said polishing pad overlapping with at least a portion of the semiconductor wafer during a planarization operation; and a polishing head, cooperatively engaged with said polishing pad, for holding the semiconductor wafer and applying the semiconductor wafer against said polishing pad.

2. The apparatus of claim 1 wherein said polishing head is rotatable in a first direction and said polishing pad is rotatable in a second direction.

3. The apparatus of claim 2 wherein said first direction is opposite to said second direction.

4. The apparatus of claim 2 further comprising a rotatable table, said polishing pad securely attached to said rotatable table, said rotatable table for rotating said polishing pad in said second direction.

5. The apparatus of claim 1 wherein said surface of said polishing pad has an abrasive portion.

6. The apparatus of claim 1 further comprising a vacuum chuck set, attached to said polishing head, for securing the semiconductor wafer.

7. The apparatus of claim 1 wherein said nonabrasive portion includes a hole disposed in said polishing pad.

8. The apparatus of claim 7 wherein said hole is circular and disposed centrally in said polishing pad.

9. The apparatus of claim 1 wherein said nonabrasive portion is implemented as a hole.

10. An apparatus for planarizing a semiconductor wafer, the apparatus comprising:

a polishing pad having a surface for polishing the semiconductor wafer, said surface having a nonabrasive portion, said polishing pad rotatable in a first direction, said nonabrasive portion having a circular shape and being disposed at center of said polishing pad, said polishing pad having a diameter greater than a diameter of the semiconductor wafer, said nonabrasive portion of said polishing pad overlapping with at least a portion of the semiconductor wafer during a planarization operation;

a polishing head, cooperatively engaged with said polishing pad, for holding the semiconductor wafer and applying the semiconductor wafer against said polishing pad, said polishing head rotatable in a second direction; and a rotatable table, said polishing pad securely attached to said rotatable table, said rotatable table for rotating said polishing pad in said first direction.

11. The apparatus of claim 10 wherein said surface of said polishing pad has an abrasive portion.

12. The apparatus of claim 10 further comprising a vacuum chuck set, attached to said polishing head, for securing the semiconductor wafer.

13. A polishing pad having a surface for planarizing a semiconductor wafer in a chemical mechanical polishing apparatus, the polishing pad comprising:

a first portion on the surface, said first portion having a first degree of abrasiveness; and a second portion on the surface, said second portion having a second degree of abrasiveness and being disposed at center of said polishing pad, said second degree less than said first degree, said polishing pad having a diameter greater than a diameter of the semiconductor wafer, said nonabrasive portion of said polishing pad overlapping with at least a portion of the semiconductor wafer during a planarization operation.

14. The apparatus of claim 13 wherein said second degree is not abrasive to the semiconductor wafer.

15. The apparatus of claim 13 wherein said second portion is round and centrally disposed in said polishing pad.

16. An apparatus for planarizing a semiconductor wafer, the apparatus comprising:

a polishing pad for polishing the semiconductor wafer, said polishing pad having a removed portion, said removed portion being disposed at a center of said polishing pad, said polishing pad rotatable in a first direction said polishing pad having a diameter greater than a diameter of the semiconductor wafer, said nonabrasive portion of said polishing pad overlapping with at least a portion of the semiconductor wafer during a planarization operation; and a polishing head, cooperatively engaged with said polishing pad, for holding the semiconductor wafer and applying the semiconductor wafer against said polishing pad, said polishing head rotatable in a second direction.

17. The apparatus of claim 16 further comprising a rotatable table, said polishing pad securely attached to said rotatable table, said rotatable table for rotating said polishing pad in a second direction.

18. The apparatus of claim 16 wherein said polishing pad has an upper surface that is abrasive.

19. The apparatus of claim 16 further comprising a vacuum chuck set, attached to said polishing head, for securing the semiconductor wafer.

20. The apparatus of claim 16 wherein the removed portion is a round cavity at the center of said polishing pad.

* * * * *